US005117536A

United States Patent [19]

Beach et al.

[11] Patent Number: 5,117,536

[45] Date of Patent: Jun. 2, 1992

[54] BINDING STRAP WITH INTEGRAL CONNECTING STRUCTURE AND ANTI-DISENGAGEMENT FEATURE

[75] Inventors: John R. Beach, Elmhurst; Donald J. Van Erden, Wildwood, both of Ill.

[73] Assignee: Signode Corporation, Glenview, Ill.

[21] Appl. No.: 688,865

[22] Filed: Apr. 22, 1991

[51] Int. Cl.[5] ..... B65D 63/02

[52] U.S. Cl. ..... 24/20 R; 24/20 EE

[58] Field of Search ..... 24/20 R, 20 EE, 20 CW, 24/20 W, 23 W, 23 EE; 403/393

[56] References Cited

U.S. PATENT DOCUMENTS

| | | | |
|---|---|---|---|
| 156,262 | 10/1874 | Terrell . | |
| 161,409 | 3/1875 | Hardman . | |
| 165,407 | 7/1875 | Dawson . | |
| 180,910 | 8/1876 | Olmsted . | |
| 182,031 | 9/1876 | Millinger . | |
| 203,255 | 5/1878 | Ewing . | |
| 295,340 | 3/1884 | Bommarius | 24/23 EE |
| 1,277,076 | 8/1918 | Ireland | 24/20 CW |
| 1,378,508 | 5/1921 | Woodward . | |
| 1,393,791 | 10/1921 | Kimball et al. | 24/23 W |
| 1,606,331 | 11/1926 | Anderson . | |
| 1,687,854 | 10/1928 | Anderson | 24/20 EE |
| 1,936,909 | 5/1931 | MacChesney | 113/116 |
| 2,035,351 | 3/1936 | Taylor | 24/20 |
| 2,253,874 | 8/1941 | Tucker et al. | 88/19.5 |
| 2,268,339 | 12/1941 | Leslie | 24/29 |
| 2,276,988 | 3/1942 | Leslie | 24/20 |
| 2,898,673 | 4/1959 | Ericson | 29/224 |
| 3,137,047 | 6/1964 | Mosey | 24/20 |
| 3,177,538 | 4/1965 | Timmerbell | 24/20 |
| 3,188,706 | 6/1965 | Partridge | 24/20 EE |
| 3,234,610 | 2/1966 | Timmerbell et al. | 24/20 |
| 3,303,540 | 2/1967 | Beach | 24/20 EE |
| 3,426,392 | 2/1969 | Timmerbell | 24/20 |
| 3,457,599 | 7/1969 | Timmerbell et al. | 24/20 |
| 3,921,799 | 11/1975 | Meier | 206/83.5 |
| 3,934,918 | 1/1976 | Kress et al. | 294/74 |
| 3,935,616 | 2/1976 | Simmons | 24/20 |
| 4,031,594 | 6/1977 | Cepuritis | 24/20 |
| 4,048,697 | 9/1977 | Duenser | 24/20 |
| 4,062,086 | 12/1977 | Wojcik | 24/20 |
| 4,080,689 | 3/1978 | Meier | 24/20 |
| 4,226,007 | 10/1980 | Duenser | 24/20 |
| 4,228,565 | 10/1980 | Lems et al. | 24/20 |
| 4,825,512 | 5/1989 | Tremper et al. | 24/20 EE |
| 4,980,953 | 1/1991 | Watanabe et al. | 24/20 EE |

FOREIGN PATENT DOCUMENTS

| | | |
|---|---|---|
| 648535 | 7/1937 | Fed. Rep. of Germany . |
| 822674 | 11/1951 | Fed. Rep. of Germany . |
| 3024573 | 6/1983 | Fed. Rep. of Germany . |

*Primary Examiner*—Victor N. Sakran

*Attorney, Agent, or Firm*—T. W. Buckman; D. J. Breh

[57] ABSTRACT

A strap, which can be a strip of metal, is provided for forming a tight loop about an object and for forming a sealless strap connection between overlapping strap portions. The strap has first and second oppositely facing surfaces and two connecting regions spaced apart lengthwise on the strap. Each connecting region has at least one joint element for engaging a corresponding joint element on the other connecting region to connect the regions together upon displacement of the connecting regions lengthwise in opposite directions tending to increase the loop size. An engaging member projects from the strap first surface at one of the connecting regions. A cavity is defined in the strap at the other of the connecting regions and opens to the strap second surface for receiving the engaging member. The cavity is defined at one end by an abutment surface for being engaged by the engaging member. The cavity is located on the strap relative to the engaging member so that, after the strap connecting regions have been relatively displaced lengthwise in the direction tending to increase the loop size and effect engagement between the joint elements, the engaging member can engage the abutment surface. This prevents relative lengthwise displacement of the connecting regions in the directions tending to decrease the loop size which would effect disengagement of the joint elements.

11 Claims, 5 Drawing Sheets

Fig. 4
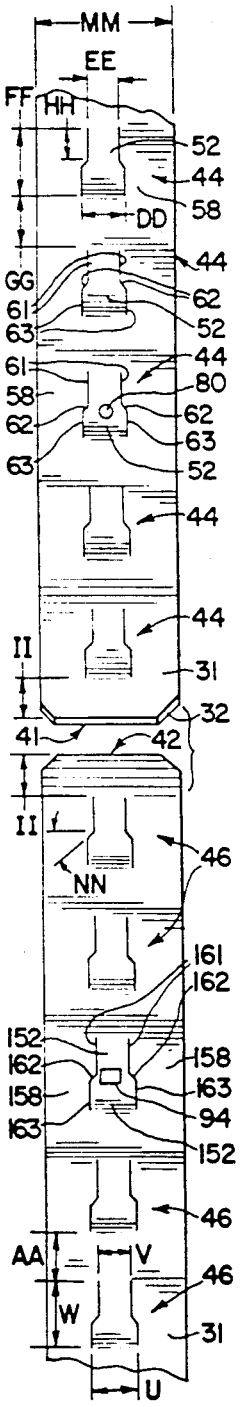
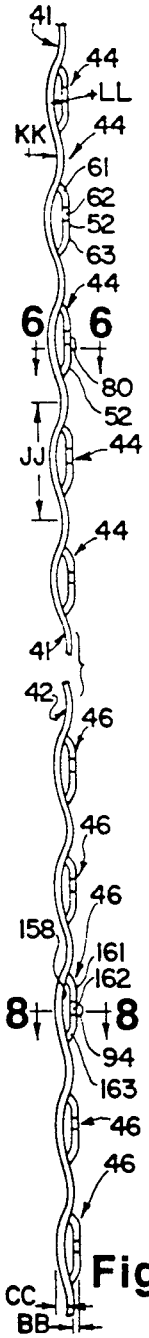
Fig. 5
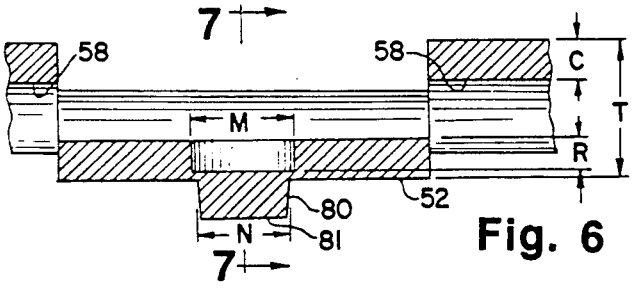
Fig. 6
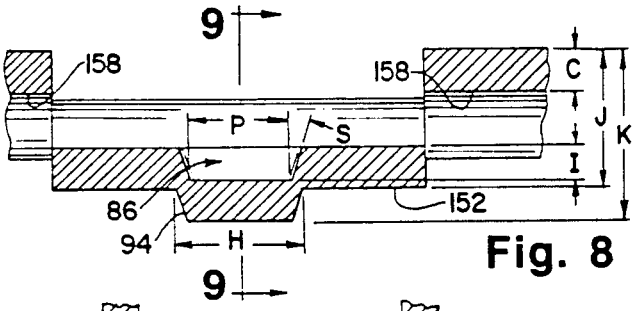
Fig. 8
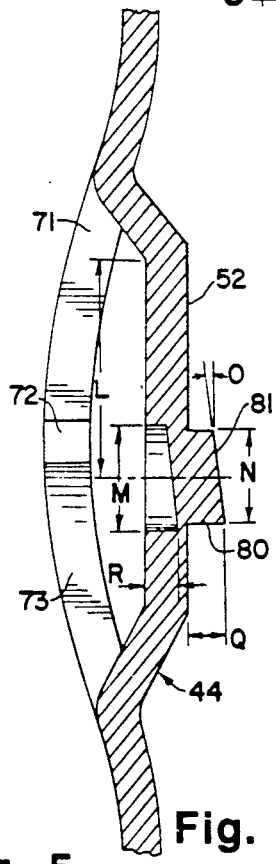
Fig. 7
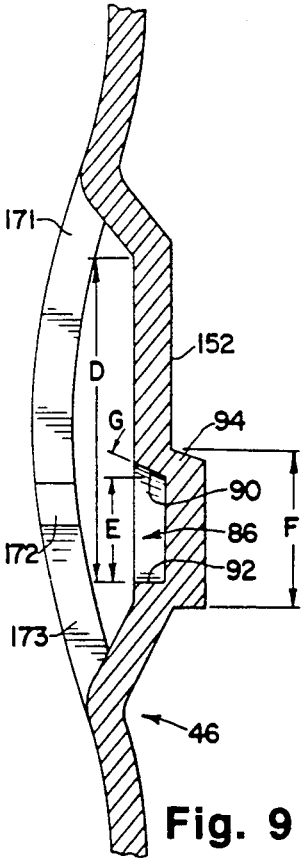
Fig. 9

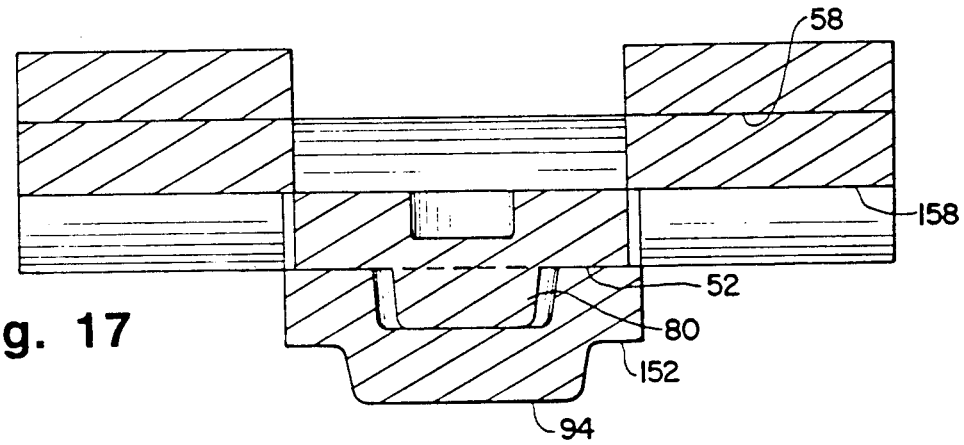
Fig. 17
Fig. 18
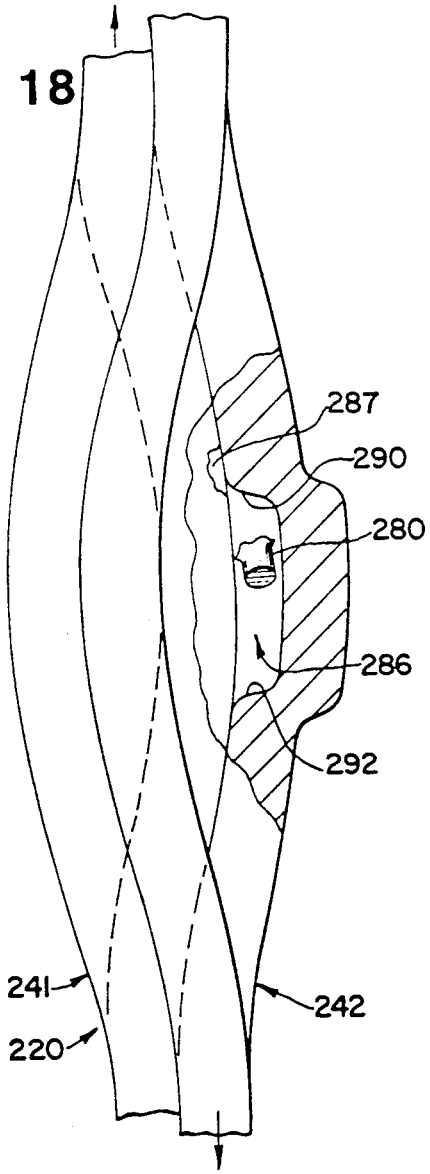
Fig. 19
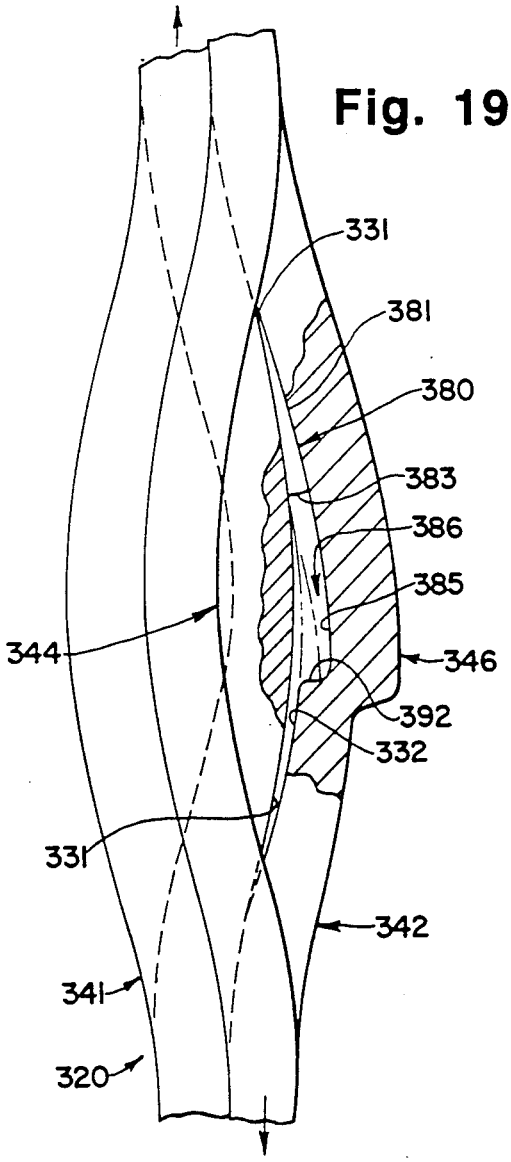

BINDING STRAP WITH INTEGRAL CONNECTING STRUCTURE AND ANTI-DISENGAGEMENT FEATURE

TECHNICAL FIELD

This invention relates to a strap for forming a tight loop about an object and for forming a sealless strap connection between the overlapping strap portions The invention is particularly suitable for use with pre-compressed packages or articles (e.g., a bale of cotton or the like) which can be allowed to expand outwardly into engagement with an encircling strap that has been previously connected at its overlapping ends.

BACKGROUND OF THE INVENTION AND TECHNICAL PROBLEMS POSED BY THE PRIOR ART

A compressible package or quantity of compressible material may be more efficiently handled, transported, shipped, etc., if it is first substantially compressed to a smaller volume and retained in a compressed configuration by retention means, such as encircling bindings or ligatures. One widely used method employs metal straps which are encircled about the object that has been compressed in a suitable press. The overlapping ends of each strap are connected together, and the straps maintain the object under some degree of compression after the press releases the object to allow the object to expand somewhat into tight engagement with the encircling strap loops.

According to conventional practices, the overlapping strap ends may be connected together by means of interlocking structures formed in the strap ends either before or after the strap has been disposed in a loop around the object or compressed material. In one technique that is preferred in some applications, the individual straps are initially provided with the end connection structures or joint configurations already formed into the strap ends. The user then need only encircle the compressed object with the strap, align the strap ends, push the strap ends together in face-to-face contact, and then effect a small amount of relative longitudinal displacement between the strap ends to establish an initial, although not fully completed, connection.

Next, when the press holding the object under high compression is released, the expanding object imposes a longitudinally acting tension force or hoop stress load throughout the strap, and this causes a further relative displacement to occur between the overlapping strap ends so as to more fully engage the joint structures and complete the joint formation. Such joint structures are disclosed in, for example, U.S. Pat. Nos. 4,825,512 and 4,980,953.

The above-described technique for strapping an object or quantity of compressed material is particularly well suited for use in industries wherein highly compressible material is accumulated and formed into bales for shipment or further processing. This strapping technique is widely used with cotton bales.

In the cotton industry, cotton is frequently baled at one location by a press that produces a bale which has a first size and density and which is bound by a first set of metal straps. The bale is then shipped to another location where the straps may be removed so that the cotton can be processed or so that the bale can be further compressed to form an even higher density, smaller bale which is bound with appropriate, shorter straps.

When a bale is initially formed by a suitable press, the bale is encircled by the strap or straps, and the initial connection is made between the ends of each strap while the strap loop is relatively loose around the compressed bale. The strap connection is initially established by manually interlocking the strap connection structures on the two overlapping ends of each strap. However, the disengagement resistance of the initial connection may be relatively low. This is because, of course, no tension is maintained on the initially formed connection to hold it in tight engagement. Further, a typical metal strap connection cannot be manually manipulated or pulled with sufficient force to effect a large amount of frictional engagement and/or deformation engagement of the joint structures.

Consequently, before the press is released, there is a possibility that the loose strap loop could be accidentally bumped. This could result in the separation of the overlapping strap ends before the expanding bale can subject the joint to a high tension load (typically between 1,000 pounds and 3,000 pounds) so as to establish, and maintain, a complete engagement of the joint structures on each overlapping strap end.

It will be appreciated that disengagement of a manually formed initial joint can be a significant problem in a typical cotton baling operation where up to six strap loops are first loosely placed around a single bale. Indeed, it would not be unlikely to expect that, in one or more of the strap loops, the initial strap connection, either under its own weight or due to vibrations or other unintentionally applied external forces, may become disengaged prior to release of the bale press.

A variety of strap joint configurations have been proposed for overcoming the problem of unintentional disengagement of the ends of an untensioned strap encircling a compressed bale. For example, see U.S. Pat. Nos. 3,935,616, 4,048,697, 4,062,086, 4,031,594, 4,226,007, 4,228,565, and 4,825,512.

While these designs may function generally satisfactorily for the specific applications for which they were intended, there is a need to provide an improved strap in which the connection of the overlapping strap ends has a relatively high joint strength or tension load capability for use with today's high compression bales.

Further, it would be desirable to provide such an improved strap with a connection structure that would permit the initial strap end connection to be manually established very rapidly and easily without requiring excessive, or particularly delicate, manipulations.

Further, it would be beneficial if such an improved strap could function reliably to prevent disengagement of the manually formed, initial joint.

It would also be advantageous if such an improved strap with an anti-disengagement feature could nevertheless accommodate substantial relative longitudinal movement of the overlapping strap ends when subjected to the high tension forces exerted by highly compressed bales. In particular, it would be beneficial to provide an anti-disengagement feature that would not interfere with the full tension loading of the joint structure and with the longitudinal movement that is produced by the high tension forces imposed by the bale on the strap.

Furthermore, it would be desirable to provide an improved strap in which the connection structure at each end of the strap could be relatively easily and inexpensively produced.

Also, the design of the strap end connection structure should preferably accommodate high speed, or high volume, fabrication of the strap with a relatively low product reject rate. To this end, the improved strap end connection should function well without requiring the maintenance of unusually low dimensional tolerances.

The present invention provides an improved strap which can accommodate joint designs having the above-discussed benefits and features.

SUMMARY OF THE INVENTION

According to the present invention, an improved strap is provided for binding an object. The strap can be looped around a compressed bale, and the overlapping ends can be easily manipulated to form an initial connection which cannot be easily disengaged.

The strap includes a strip of material having first and second oppositely facing surfaces and having two connecting regions which are spaced-apart lengthwise on the strip. These are overlapped when the strap is looped around the object.

Each connecting region defines at least one joint element means for engaging a corresponding joint element means on the other connecting region to connect the regions together upon displacement of the connecting regions lengthwise in opposite directions tending to increase the loop size.

An engaging member projects from the first surface of one of the connecting regions. A cavity is defined in the strap at the other of the connecting regions and opens to the second surface for receiving the engaging member.

The cavity is defined at one end by an abutment surface for being engaged by the engaging member. The cavity is located on the strap relative to the engaging member so that, after the strap connecting regions have been relatively displaced lengthwise in the directions tending to increase the loop size and effect engagement between the joint element means, the engaging member can engage the abutment surface to prevent relative lengthwise displacement of the connecting regions in the reverse directions tending to decrease the loop size which would effect disengagement of the joint element means.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 4 is a fragmentary, plan view of the strap ends before they are overlapped to form an interlocking connection;

FIG. 5 is a side, elevational view of the strap ends shown in FIG. 4;

FIG. 6 is a greatly enlarged, cross-sectional view taken generally along the plane 6—6 in FIG. 5;

FIG. 7 is a fragmentary, cross-sectional view taken generally along the plane 7—7 in FIG. 6;

FIG. 8 is a greatly enlarged, cross-sectional view taken generally along the plane 8—8 in FIG. 5;

FIG. 9 is a fragmentary, cross-sectional view taken generally along the plane 9—9 in FIG. 8;

FIG. 17 is a greatly enlarged, cross-sectional view taken generally along the plane 17—17 in FIG. 16;

FIG. 18 is a view similar to FIG. 16 but showing an alternate embodiment of the strap; and FIG. 19 is a view similar to FIG. 18 but showing still another embodiment of the strap present invention.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

The strap of this invention may be employed to bind a bale that is compressed with a conventional press or other mechanism, and the strap joint configuration may be formed with suitable dies, tools, or other mechanisms. The details of such mechanisms and tools, although not fully illustrated or described, will be apparent to those having skill in the art and an understanding of the necessary functions of such mechanisms and tools. The detailed descriptions of such mechanisms and tools are not necessary to an understanding of the invention and are not herein presented because such mechanisms form no part of the present invention.

Figure 1:
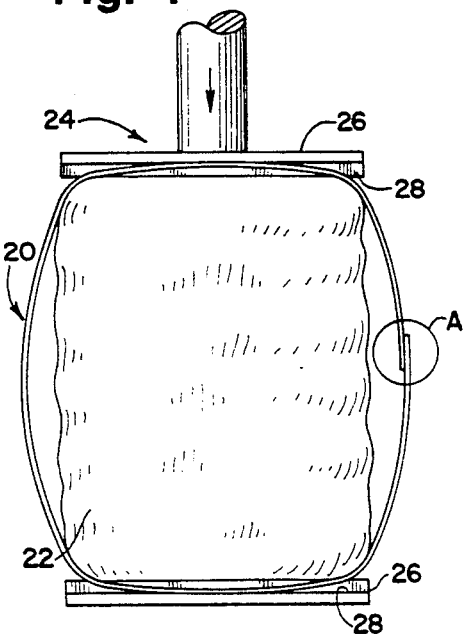
FIG. 1 is a diagrammatic view of a bale of material which has been compressed in a press and about which a strap of the present invention has been encircled and manually manipulated so that the overlapping ends of the strap are initially engaged.
Figure 2:
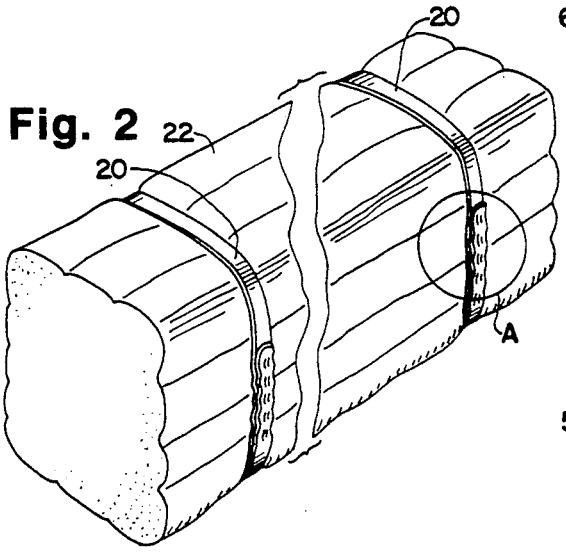
FIG. 2 is a perspective view of a strap of the present invention which has been banded about a bale of previously compressed material that was allowed to partially expand into engagement with the strap.

A strap embodying the present invention is designated generally by the reference numeral 20 in FIGS. 1 and 2 wherein the strap 20 is shown disposed in a loop around an object, such as a compressed cotton bale 22. In the preferred embodiment, the strap 20 is fabricated from a stiff sheet material such as steel.

Typically, when cotton or other compressible material is formed into a bale, the material is compressed in a press 24 to form the bale 22. One or more straps 20 are then placed around the bale 22 while it is still held in the press 24. To this end, as illustrated in FIG. 1, the press 24 may employ a pair of press members 26 for contacting opposite sides of the bale 22. The press members 26 have slots or channels 28 for receiving the strap 20 as it is passed around the bale 22.

The ends of the strap 20 are provided with joint forming elements, and the ends of the strap 20 are overlapped and connected together as illustrated diagrammatically in the circle A in FIGS. 1 and 2. The nature of the connection is described in detail hereinafter.

Typically, the overlapping strap ends are connected in an outwardly bowed region of the strap loop, and the connection is initially effected by a manual manipulation in which the connection is "hand set" but not fully established. The connection is subsequently completed when the press 24 is operated to release the press members 26 from the bale 22 to allow the bale 22 to expand somewhat into engagement with the strap 20.

The expanding bale 22 imposes a longitudinally acting tension force or hoop stress load throughout the strap loop. This force effects a relative displacement between the overlapping strap ends so as to more fully engage the joint elements and complete the connection.

Typically, a cotton bale may impose a tension load of between 1,000 pounds and 3,000 pounds on the strap 20. When the bale 22 expands into the strap or straps 20, each strap 20 tends to become sunk into the bale 22 somewhat as illustrated in FIG. 2, and this forms a loop that has curved corners rather than sharp right angle corners.

Figure 3:
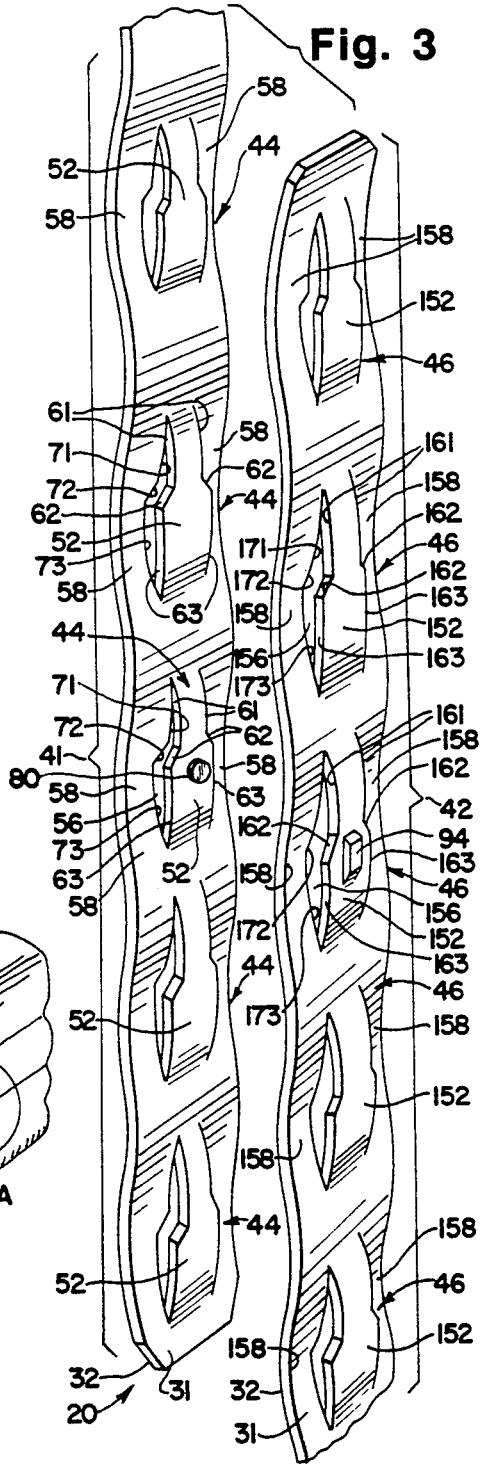
FIG. 3 is a fragmentary, perspective view of the ends of the loop of strap in a separated orientation prior to being connected together.

The basic joint element structure of the preferred embodiment of the strap of present invention is illustrated in FIGS. 3-5. The strap 20 has first and second oppositely facing surfaces 31 and 32, respectively. The strap also includes a first connecting region 41 and a second connecting region 42. The connecting regions 41 and 42 are typically spaced-apart lengthwise along the strap. In most applications, the connecting regions 41 and 42 are located at the two opposite ends of the strap.

Each connecting region 41 and 42 defines at least one joint element, and in the illustrated preferred embodiment, connecting region 41 defines five, longitudinally spaced joint elements 44. The connecting region 42 defines five, longitudinally spaced joint elements 46. Each joint element 44 corresponds with a particular joint element 46, and the corresponding joint elements are adapted to engage and form a joint or connection.

In the illustrated preferred embodiment, the basic shape of each joint element 44 is identical to the basic shape of each joint element 46. However, the width and length of the joint element 44 are preferably less than the width and length, respectively, of the joint element 46 so as to accommodate the nesting engagement of the joint elements as will be described in detail hereinafter.

Each joint element 44 may be characterized as including a raised or punched-out central web 52. Each web 52 is defined on each side by a pair of spaced-apart, mirror image slits 56. Each slit 56 is defined along its inner edge by an edge of the raised web 52 and is defined along its outer edge by an edge of a lateral web 58 of the strap. The lateral webs 58 on each side of the central web 52 are each deformed or offset outwardly relative to the strap second surface 32. This offset is in a direction opposite to the offset of the central web 52.

Each lateral side edge of the central web 52 may be characterized as having a first edge 61 extending generally parallel to the strap edge, a second edge 62 extending from the first edge 61 at an oblique angle outwardly toward the strap edge, and a third edge 63 extending from the second edge 62 parallel to the strap edge. The intermediate, second edge 62 may be characterized as a shoulder or lateral jog.

The edges 61 on either side of the web 52 are parallel to each other. The edges 63 on either side of the web 52 are also parallel. The distance between the two edges 6 is less than the distance between the two edges 63. The shoulders or edges 62 can thus be characterized as diverging outwardly from the edges 61.

Further, the narrow portion of the web 52 between the edges 61 may be regarded as a neck portion, and the wider portion of the web 52 between the edges 63 may be regarded as a body portion.

The edge of each strap lateral web 58 defined by the slot 56 has a configuration that corresponds to, and that is in vertical registry with, the edges 61, 62, and 63 of the outwardly offset central web 52. In particular, each lateral web 58 includes a first edge 71, a second edge or shoulder 72, and a third edge 73. The edges 71 and 73 are parallel to the strap side edge and are connected by the second edge or shoulder 72 which diverges outwardly toward the strap side edge relative to the first edge 71.

It will be noted that the joint elements 44 are oriented on the strap connecting region 41 so that the wide body part of the raised central web 52 (i.e., the portion defined between the more widely spaced-apart edges 63) is closer to the strap end than is the narrow neck portion (i.e., the portion defined between the less widely spaced side edges 61).

In the illustrated preferred embodiment, there are five joint elements 44, and the elements 44 are equally spaced-apart lengthwise along the first connecting region 41 of the strap. Further, each joint element 44 is laterally positioned in the middle of the strap width.

The joint elements 46 on the second connecting region 42 are similarly equally spaced lengthwise along the strap and are laterally positioned at the middle of the strap width. Each joint element 46 is adapted to engage a corresponding one of the joint elements 44 and has a configuration that is generally similar to the configuration of the joint elements 44.

In particular, each joint element 46 includes an offset, central web 152 defined on each side by a pair of spaced-apart slots 156. Each side of the central web 152 has a first side edge 161, a second side edge or shoulder 162, and a third side edge 163. The other side of the slot 156 is defined by a lateral web 158 having a first side edge 171, a second edge or shoulder 172, and a third side edge 173.

On the second connecting region 42, the orientation of each joint element 46 is reversed relative to each joint element 44 on the first connecting region 41. The neck or narrower portion of each joint element 46 is closer to the distal end of the strap than is the wider portion of the joint element 46.

The joint elements 44 and 46 can be readily formed in the strap with a suitable punch and die apparatus. The joint elements can be incorporated in straps of various lengths and thicknesses.

When the strap is formed into a loop and the connecting regions 41 and 42 are overlapped, the orientation of the second connecting region joint elements 46 then matches the orientation of the first connecting region joint elements 44 so that registration of corresponding joint elements can be established. It will be appreciated that when the strap 20 is formed into a loop to overlap the connecting regions 41 and 42, the strap surface 31 on the connecting region 41 faces the second surface 32 on the connecting region 42.

Figure 10:
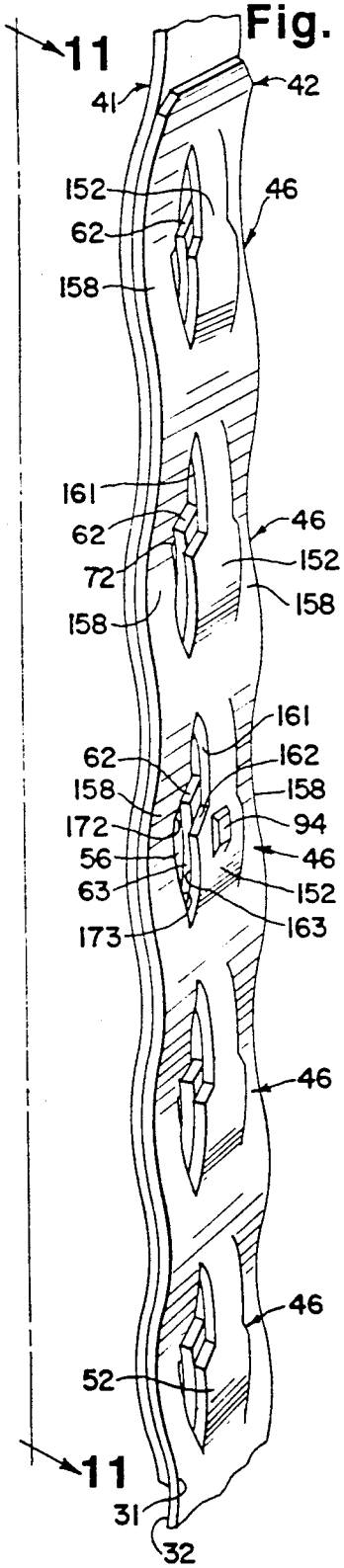
FIG. 10 is a fragmentary, perspective view of the overlapping end portions of the strap shown in the fully engaged orientation wherein the joint has been completed and subjected to full tension imposed by the expanding bale.
Figure 11:
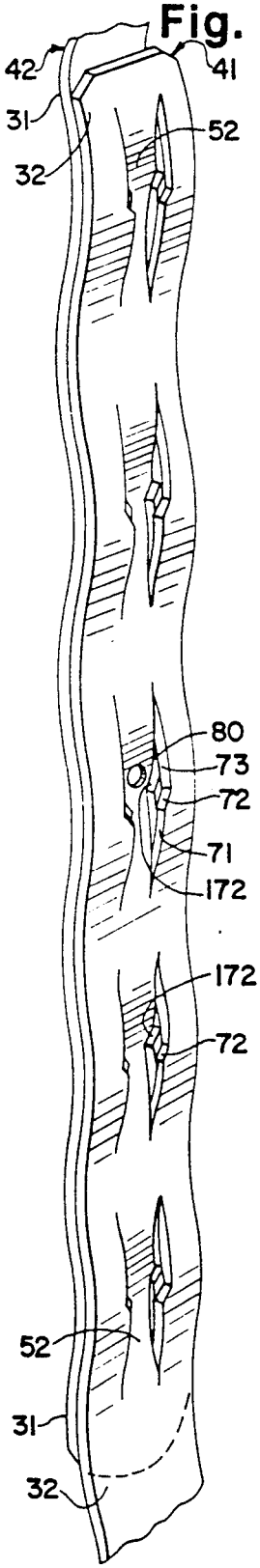
FIG. 11 is a fragmentary, perspective view of the strap connection illustrated in FIG. 10 as viewed along the plane 11—11 in FIG. 10 but as further rotated 180° end-for-end from the position illustrated in FIG. 10.
Figure 12:
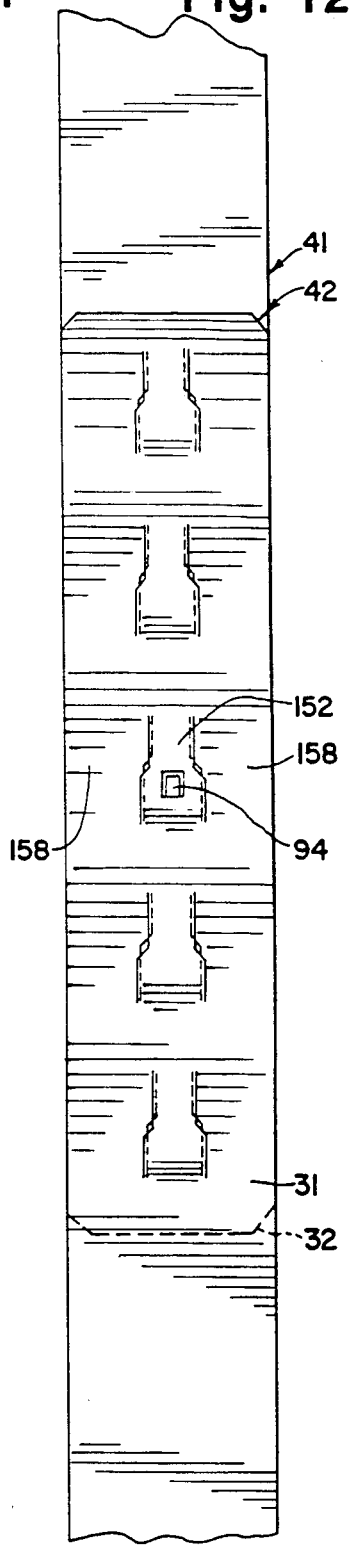
FIG. 12 is a top plan view of the strap connection shown in FIG. 10.

When the overlapping connecting regions 41 and 42 are aligned with the connecting elements 44 and 46 substantially in registration, the strap ends can be pressed together as illustrated in FIG. 10 so that the joint elements have somewhat of a nesting relationship. To this end, it will be recalled that the joint elements 46 on the second connecting region 42 are slightly larger than the joint elements 44 on the first connecting region 41.

Next, relative lengthwise displacement is effected between the connecting regions 41 and 42, and the displacement is effected in opposite directions which tend to increase the loop size. That is, with reference to FIG. 3, the connecting region 41 would be moved toward the top and the connecting region 42 would be moved toward the bottom.

Typically, the initial lengthwise displacement of the connecting regions 41 and 42 to create the initial engagement is effected manually while the strap is loosely looped around the compressed bale 22 in the press 24 (FIG. 1).

When the lengthwise displacement is effected between the connecting regions 41 and 42, the shoulder 62 of each first connecting region joint element 44 is received in one of the slits 156 of the corresponding joint element 46 on the second connecting region 42. The outwardly projecting shoulder 62 is displaced lengthwise (toward the top as viewed in FIG. 10) and slides over the oppositely projecting shoulder 172 of the mating joint element 46.

The shoulder 62 can slide relative to the shoulder 172 between the edges 161 and 171 of the joint element 46. Since the edges 161 and 171 converge, this configuration serves to tightly engage and trap the shoulder 62 between the webs 152 and 158, if substantial relative lengthwise displacement is effected. In addition, depending upon the amount of displacement, the web 52, as well as the webs 152 and 158, could deform somewhat to increase the engagement and resistance to pull out.

Typically, when the connecting regions 41 and 42 are first manually aligned and initially connected, only a small amount of relative displacement can be effected because it is not possible to manually apply very large, oppositely acting, tension forces to the overlapping strap ends. Indeed, the joint is intended to be completed by allowing the expanding bale to apply the high tension forces.

Consequently, when the initial joint is manually established, the amount of engagement between the first connecting region shoulder 62 and the second connecting region shoulder 172 is very limited. Further, frictional forces tending to hold the connecting regions 41 and 42 together are small. Accordingly, any movement of the strap loop, which may be caused an accidental impact, vibration, or the like, may cause the connecting regions 41 and 42 to separate before the press can be released and the high tension force imposed on the strap loop to establish a completed, high strength joint.

The strap 20 includes a novel structure for preventing such disengagement of a manually set strap connection. Specifically, the first connecting region 41 includes an engaging member 80. The engaging member 80 has a cylindrical configuration and defines a cylindrical engaging surface which is elevated above the strap first surface 31. The engaging member has an end face 81 (FIGS. 6 and 7) slanting away from the distal end of the strap at the first connecting region 41. The engaging member 80 may be formed in the strap 20 with a suitable punch and die.

In the illustrated preferred embodiment, the engaging member 80 is located in the middle of the strap width. Preferably, the member 80 is located between the shoulders 62 on the middle one of the five joint elements 44.

The strap connecting region 42 is provided with a novel structure for receiving the engaging member 80. Specifically, a cavity 86 is defined in the strap 20 at the second connecting region 42 and opens to the second surface 32. The cavity 86 is defined at opposite ends by a front surface 90 and a rear abutment surface 92. The rear abutment surface 92 is farther from the strap end at the second connecting region 42 than is the front surface 90. In the illustrated preferred embodiment, the abutment surface 92 is substantially perpendicular to the length of the strap, and the front surface 90 slants at an oblique angle toward the distal end of the strap at the second connecting region.

The cavity 86 is formed in the web portion 152 of the middle one of the five joint elements 46 on the second connecting region 42. Preferably, the cavity 86 is made by deforming the strap with a suitable punch and die apparatus to create the cavity 86 in an outwardly projecting portion or receptacle 94.

In the illustrated preferred embodiment, the receptacle 94 has a rear end which corresponds to the rear abutment surface 92 and which is perpendicular to the strap length. The receptacle 94 also has a slanted front end corresponding to the slanting front surface 90. The two lateral sides of the receptacle 94 slant outwardly and correspond with slanting side surfaces in the cavity 86. The top of the receptacle 94 forms a cover for protecting the engaging member 80 when it is received within the cavity 86.

The sequence of forming the joint between the overlapping connecting regions 41 and 42 is illustrated diagrammatically in FIGS. 13–16. In these figures, the length of cavity 86 is exaggerated for ease of illustrating the positions and relative movements of the strap connecting regions 41 and 42.

Figure 13:
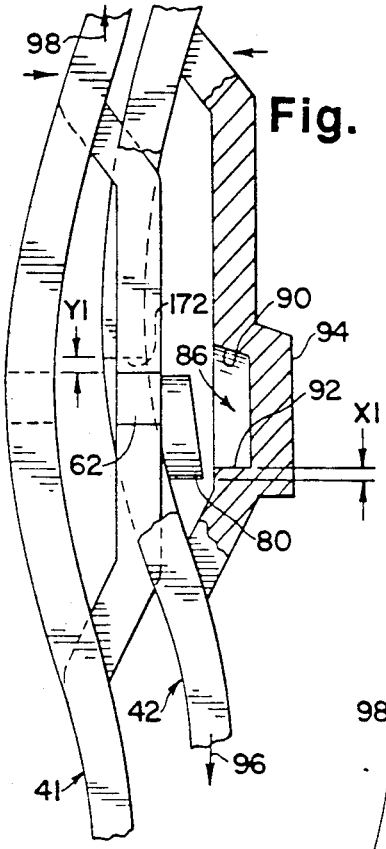
FIGS. 13-16 are greatly enlarged, fragmentary, side elevational views, partly in cross section, and showing the sequence of the longitudinal displacement of the overlapping strap ends as the joint is formed.

The connecting regions 41 and 42 are typically slightly offset initially so that the true registration of the joint elements 41 and 42 does not yet exist and so that the strap loop is slightly smaller than will be the case when the connection is subsequently established. This is illustrated in FIG. 13 wherein the shoulder 172 of the joint element 46 is located at a distance $Y_1$ above the shoulder 62 of the joint element 44. In this orientation, the engaging member 80 is located beyond the cavity 86. Indeed, the engaging surface of the engaging member 80 is a distance $X_1$ away from the abutment surface 92 of the joint element 46.

Next, while the strap connecting regions 41 and 42 are held together in face-to-face contact, relative lengthwise displacement of the connecting regions 41 and 42 is effected. This is illustrated in FIG. 14 which shows the connecting region 42 moving downwardly as indicated by the arrow 96 and which shows the connecting region 41 moving upwardly as indicated by the arrow 98.

Figure 14:
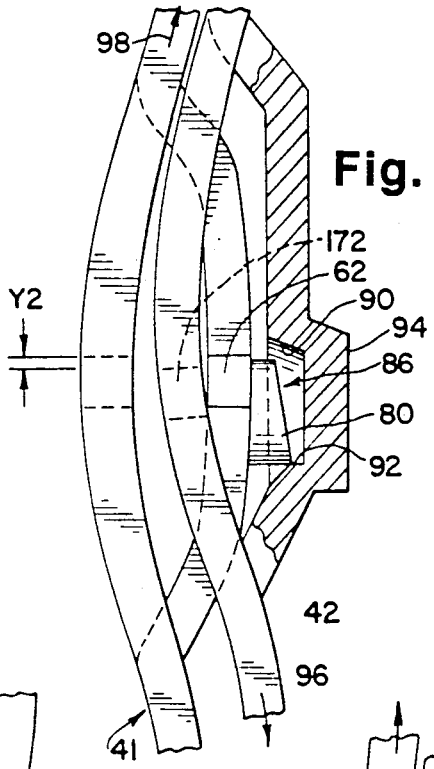

Relative lengthwise displacement is effected so as to move the connecting regions 41 and 42 in opposite directions to a slightly engaged position as illustrated in FIG. 14. In this slightly engaged position, the shoulder 62 (and web 52) of the joint element 44 is now positioned to overlap the shoulder 172 (and web 158) of the joint element 46. The length of the engagement is indicated in FIG. 14 by the dimension $Y_2$. In this position, the engaging member 80 has just been received in the cavity 86 and adjacent the rear abutment wall 92. During the manual relative displacement of the connecting regions 41 and 42, a snapping sensation may be felt as the engaging member 80 slides into the cavity 86.

Figure 15:
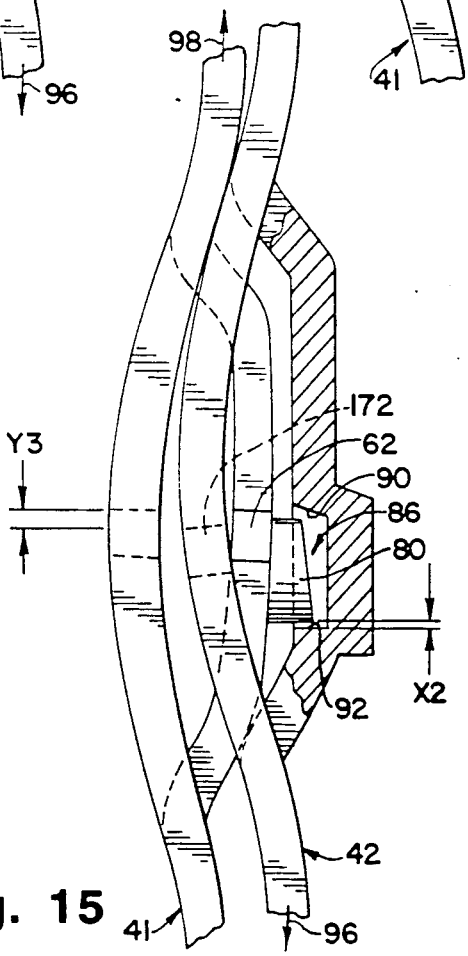

It has been noted that the relative displacement of the connecting regions 41 and 42 from the positions illustrated in FIG. 13 to the positions in FIG. 14 is effected manually. It will be appreciated that it is not necessary for the relative displacement or movement to be manually terminated at the precise position shown in FIG. 14 (where the engaging member 80 has just entered the cavity 86). Indeed, further manual displacement would typically occur as illustrated in FIG. 15 so that there would be some clearance $X_2$ between the engaging member 80 and the rear abutment surface 92. The shoulders 62 and 172 would be further overlapped by an amount $Y_3$.

In any case, once the engaging member 80 has been received in the cavity 86, there is some overlap of the engaging shoulders of the joint elements 44 and 46. Further, owing to the shape of the rear abutment surface 92 and of the engaging member 80, it is not possible to effect relative lengthwise displacement of the connecting regions 41 and 42 in the reverse directions that would tend to disengage the connection. That is, it would not be possible to move the connecting region 41 in the direction of arrow 96 and/or move the connecting region 42 in the direction of the arrow 98.

Movement of the connecting regions 41 and 42 in these reverse directions, if permitted, would tend to decrease the loop size, and that would result in the disengagement of the overlapping shoulders. However, as can be seen in FIG. 14, when the engaging member 80 contacts the abutment surface 92 to prevent such reverse displacement, there is still an overlap of the engaged shoulders by an amount of $Y_2$.

Figure 16:
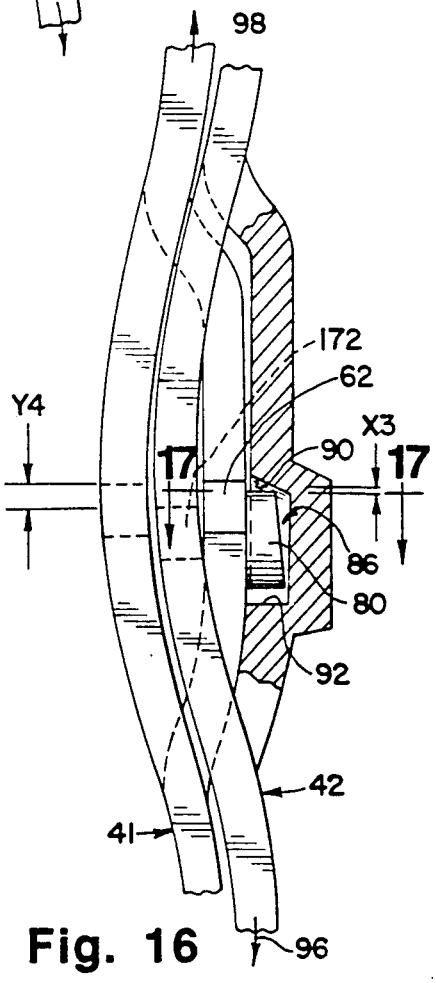

The cavity 86 is dimensioned to accommodate the application of full tension to the strap loop and to thus accommodate the establishment of the complete joint. This is illustrated in FIG. 16 wherein further relative displacement between the connecting regions 41 and 42 has occurred. Typically, this additional relative displacement results from the imposition of a high tension load on the strap loop when the press 24 is released from the bale 22 and the bale expands into engagement with the strap loop. This displaces the connecting regions 41 and 42 further in the opposite directions tending to increase the loop size. This results in an additional, greater overlap or engagement of the shoulders of the joint elements 44 and 46. This engagement is illustrated in FIG. 16 by the overlap dimension $Y_4$. The increased tension and engagement may tend to deform the joint elements somewhat as illustrated in FIG. 16 as the connecting regions 41 and 42 become more closely nested.

When the connecting regions 41 and 42 are in the position illustrated in FIG. 16, the strap 20 has been subjected to the high tension imposed upon the strap by the bale 22, and the forces are balanced so that there is no further relative displacement between the connecting regions 41 and 42. In this condition of maximum relative displacement, there is a clearance between the engaging member 80 and the front surface 90, and this is designated in FIG. 16 by the clearance dimension $X_3$. Because the engaging member 80 does not engage the front surface 90, there is no interference with the maximum displacement of the connecting regions 41 and 42. Accordingly, the maximum joint strength can be achieved.

The location and length of the cavity 86 would typically be established to accommodate (1) the position of the engaging member when the initial connection is manually set (FIG. 15) and (2) the subsequent position of the engaging member after the high tension imposed on the strap loop has moved the engaging member to its final position (FIG. 16).

In a preferred form of the present invention, the joint elements are formed in steel strap having a width of about 19 mm. and a thickness of about 0.76 mm. The strap end connecting region dimensions designated by reference letters in FIGS. 1-17 are set forth below:

| | | | |
|---|---|---|---|
| C | 0.76 mm. | U | 7.0 mm. |
| D | 6.2 mm. | V | 5.0 mm. |
| E | 2.0 mm. | W | 9.5 mm. |
| F | 3.0 mm. | AA | 6.5 mm. |
| G | 15° | BB | 0.5 mm. |
| H | 2.45 mm. | CC | 1.5 mm |
| I | 0.64 mm. | DD | 6.7 mm |
| J | 2.61 mm. | EE | 4.7 mm. |
| K | 3.25 mm. | FF | 9.5 mm. |
| L | 4.14 mm. | GG | 6.5 mm. |
| M | 2.0 mm. | HH | 5.0 mm. |
| N | 1.8 mm | II | 6.0 mm. |
| O | 7° | JJ | 16.0 mm. |
| P | 2.0 mm. | KK | 8.0 mm. |
| Q | 0.75 mm. | LL | 13.0 mm. |
| R | 0.64 mm. | MM | 19.0 mm. |
| S | 15° | NN | 35° |
| T | 2.61 mm. | | |

In a modified form of the embodiment illustrated in FIGS. 1-17, the cylindrical engaging member 80 could have a somewhat different shape. For example, it could have a right rectangular prism configuration (not illustrated).

FIG. 18 illustrates an alternate embodiment of the invention as incorporated in a strap 220 having connecting regions 241 and 242. The connecting regions include joint elements generally identical in configuration to the joint elements 44 and 46 described above with reference to FIGS. 1-17. Further, the alternate embodiment in FIG. 18 has an anti-disengagement configuration. This includes a cavity 286 and an engaging member 280 which are similar to the cavity 86 and engaging member 80, respectively, described above with reference to FIGS. 1-17.

However, in the alternate embodiment illustrated in FIG. 18, the engaging member 280 is connected to the strap by a frangible region of material which will deform or break (as at 287 in FIG. 18) when subjected to shear forces having a magnitude greater than a predetermined value.

Also, the cavity 286 is somewhat shorter than the cavity 86 described above with reference to FIGS. 1-17. The shorter cavity 286 has a rear abutment surface 292 which functions in the same manner as the abutment surface 92 described above with reference to FIGS. 1-17.

The shorter cavity 286 also includes a front abutment surface 290 which is adapted to be engaged by the engaging member 280 when the maximum relative displacement is effected between the connecting regions 241 and 244 during imposition of the high tension on the strap loop when the bale is permitted to expand against the strap loop. In order to accommodate the full range of relative displacement at high tension, the engaging member 280 deforms or breaks as illustrated in FIG. 18 so as not to interfere with the relative movement. This permits the joint elements to become as fully engaged as possible under the particular tension force imposed on the strap by the bale.

A still further embodiment of the present invention is illustrated in FIG. 19 for a strap 320 having connecting regions 341 and 342 with joint elements 344 and 346, respectively. The connecting region 341 includes an engaging member 380 defining an angled cam surface 381 which terminates in an end at a location outwardly of the strap first surface 331. The engaging member 380 further defines an engaging surface 383 extending from the end of the cam surface 381 to the strap first surface 331.

The connecting region 342 defines a cavity 386 opening to the second surface 332 of the strap. The cavity 386 is defined by a camming surface 385 which terminates in an end at a location inwardly of the strap second surface 332. The camming surface 385 is adapted to engage the cam surface 381 of the engaging member 380. The cavity 386 is further defined by a rear abutment surface 392 which extends from the end of the camming surface 385 to the strap second surface 332 for being engaged by the engaging surface 383 of the engaging member 380.

This form of the anti-disengagement structure of the present invention accommodates the increased relative displacement of the connecting regions 341 and 342 when the bale imposes high tension on the strap loop. Specifically, the relative movement is accommodated by the cavity angled camming surface 385 which is slidably engaged with the angled cam surface 381 of the engaging member 380.

It will be appreciated that the alternate embodiments illustrated in FIGS. 18 and 19 function to prevent disengagement of strap after the connection between the overlapping strap ends has been initially set manually. Further, the alternate embodiment illustrated in FIG. 18 will permit the joint to be later disengaged and opened up if the bale 22 is further compressed to loosen the strap loop. Of course, the particular joint element configuration must be designed to withstand the applied high tension forces to avoid deformations that might otherwise prevent the desired subsequent disengagement of the joint elements when the tension is released.

The novel strap of the present invention can be provided to furnish relatively high joint strength for use with high compression bales.

Further, the strap permits the initial connection to be manually established very rapidly and easily without requiring excessive, or particularly delicate, manipulations.

Further, the joint formed with the strap of the present invention can function reliably to prevent disengagement of the manually formed, initial joint before the high tension load is imposed on the strap by the expanding bale.

The anti-disengagement feature of the strap accommodates substantial relative longitudinal movement of the overlapping strap ends when the strap is subjected to the high tension forces exerted by the bale.

The anti-disengagement feature of the strap can be employed with a variety of joint element designs and can be relatively easily and inexpensively produced.

The embodiments of the anti-disengagement feature can accommodate high speed or high volume fabrication and function well without requiring the maintenance of unusually low dimensional tolerances.

It will be readily apparent from the foregoing detailed description of the invention and from the illustrations thereof that numerous variations and modifications may be effected without departing from the true spirit and scope of the novel concepts or principles of this invention.

What is claimed is:

1. A strap for binding an object, said strap comprising:

a generally flat strip of material having first and second oppositely facing surfaces and having first and second connecting regions spaced-apart lengthwise on said strip, each said connecting region defining at least one joint element means for engaging a corresponding joint element means on the other connecting region to connect the regions together when the strap is disposed in a loop around said object with said regions being overlapped, pressed together with said first surface facing said second surface, and then displaced lengthwise in opposite directions tending to increase the loop size;

an engaging member projecting from said first surface at said first connecting region and defining an engaging surface elevated above said first surface; and a cavity defined in said strap at said second connecting region and opening to said second surface for receiving said engaging member, said cavity being defined at one end by an abutment surface for being engaged by said engaging surface of said engaging member, said cavity being located on said strap relative to said engaging member so that, after a predetermined amount of relative lengthwise displacement has been effected between said strap connecting regions in the directions tending to increase the loop size and effect engagement between said corresponding joint element means, said engaging member engaging surface can engage said abutment surface to prevent relative lengthwise displacement of said connecting regions in the directions tending to decrease the loop size which would effect disengagement of said joint element means, said cavity having a length sufficient to accommodate further relative lengthwise displacement between said strap connecting regions in the directions tending to increase the loop size when a tension force is imposed on the loop of the strap.

2. The strap in accordance with claim 1 in which said cavity is defined by a rear surface perpendicular to the strap length, a slanting front surface, and two spaced-apart, slanting side surfaces.

3. The strap in accordance with claim 1 in which said cavity is defined by a deformed portion of said strip of material, said portion projecting above said first surface.

4. The strap in accordance with claim 1 in which said engaging member has a cylindrical shape with an end surface oriented at an oblique angle relative to the strap length.

5. The strap in accordance with claim 1 in which said engaging member and cavity are each located in the middle of the strap width.

6. The strap in accordance with claim 1 in which said engaging member and cavity are each located on a joint element means.

7. The strap in accordance with claim 1 in which said engaging member is defined by a deformed portion of said strip of material.

8. A strap for binding an object, said strap comprising:

a generally flat strip of material having first and second oppositely facing surfaces and having first and second connecting regions spaced-apart lengthwise on said strip, each said connecting region defining at least one joint element means for engaging a corresponding joint element means on the other connecting region to connect the regions together when the strap is disposed in a loop around said object with said regions being overlapped, pressed together with said first surface facing said second surface, and then displaced lengthwise in opposite directions tending to increase the loop size;

an engaging member projecting from said first surface at said first connecting region, said engaging member being connected to said strip of material by a frangible region of material which will break or deform when subjected to shear forces having a magnitude greater than a predetermined value;

a cavity defined in said strap at said second connecting region and opening to said second surface for receiving said engaging member, said cavity being defined at opposite ends by front and rear abutment surfaces for each being engaged by said engaging member, said abutment surfaces being spaced-apart relative to the length of the strap with said rear abutment surface being closer than said front abutment surface to said first connecting region when the strap is straight;

said cavity being located on said strap relative to said engaging member so that, after said strap connecting regions have been relatively displaced lengthwise a predetermined amount in the opposite directions tending to increase the loop size and effect engagement between said corresponding joint element means, said engaging member can engage said rear abutment surface to prevent relative lengthwise displacement of said connecting regions in the directions tending to decrease the loop size which would effect disengagement of said joint element means; and said front abutment surface functioning, during further relative lengthwise displacement of said connecting regions beyond said predetermined amount in the directions tending to increase the loop size, to break or deform said engaging member whereby said further relative displacement is accommodated.

9. A strap for binding an object, said strap comprising:

a generally flat strip of material having first and second oppositely facing surfaces and having first and second connecting regions spaced-apart lengthwise on said strip, each said connecting region defining at least one joint element means for engaging a corresponding joint element means on the other connecting region to connect the regions together when the strap is disposed in a loop around said object with said regions being overlapped, pressed together with said first surface facing said second surface, and then displaced lengthwise in opposite directions tending to increase the loop size;

an engaging member projecting from said first surface at said first connecting region, said engaging member defining an angled cam surface terminating in an end outwardly of said first surface, said engaging member further defining an engaging surface extending from said cam surface end to said first surface;

a cavity defined in said strap at said second connecting region and opening to said second surface for receiving said engaging member;

said cavity being defined in part by a camming surface terminating in an end inwardly of said second surface and adapted to engage said surface of said engaging member;

said cavity being further defined by an abutment surface extending from said camming surface to said second surface for being engaged by said engaging surface of said engaging member;

said cavity being located on said strap relative to said engaging member so that, after said strap connecting regions have been relatively displaced lengthwise a predetermined amount in the directions tending to increase the loop size and effect engagement between said joint element means, said engaging member engaging surface can engage said abutment surface to prevent relative lengthwise displacement of said connecting regions in the directions tending to decrease the loop size which would effect disengagement of said joint element means; and said camming and cam surfaces functioning to permit further relative lengthwise displacement of said connecting regions beyond said predetermined amount in the directions tending to increase the loop size whereby said further relative displacement is accommodated.

10. A strap for binding an object, said strap comprising:

a strip of material having first and second oppositely facing surfaces and having two connecting regions spaced-apart lengthwise on said strip, each said connecting region defining at least one joint element means for engaging a corresponding joint element means on the other connecting region to connect the regions together upon displacement of said connecting regions lengthwise in opposite directions tending to increase the loop size;

an engaging member projecting from said first surface at one of said connecting regions; and a cavity defined in said strap at the other of said connecting regions and opening to said second surface for receiving said engaging member, said cavity being defined at one end by an abutment surface for being engaged by said engaging member, said cavity being located on said strap relative to said engaging member so that, after said strap connecting regions have been relatively displaced lengthwise in the directions tending to increase the loop size and effect engagement between said joint element means, said engaging member can engage said abutment surface to prevent relative lengthwise displacement of said connecting regions in the directions tending to decrease the loop size which would effect disengagement of said joint element means.

11. The strap in accordance with claim 10 in which each said connecting region has five spaced-apart joint elements defining said joint element means; and each said joint element includes a pair of spaced-apart, stepped slits arranged in mirror image to each other, said strip defining a central web on one side of each slit and a lateral web on the other side of each slit, each central web being displaced outwardly in one direction from said strip first surface, each said lateral web being displaced outwardly in the opposite direction from said strip second surface, said central web being defined on each side along one of said slits by (1) a first edge parallel to said strap length, (2) a second edge extending from said first edge at an oblique angle relative to said strap length, and (3) a third edge extending from said second edge parallel to said strap length, each said lateral web being defined along one of said slits by (1) a first edge parallel to said strap length, (2) a second edge extending from said first edge at an oblique angle relative to said strap length, and (3) a third edge extending from said second edge parallel to said strap length, said first edges on each side of said central web being parallel and spaced a first distance apart, said third edges on each side of said central web being parallel and spaced apart a second distance apart which is greater than said first distance, said engaging member projecting from the middle joint element central web on the first connecting region, and said cavity being defined in the middle joint element central web on the second connecting region.

* * * * *